US005704410A

United States Patent [19]

Kuo

[11] Patent Number: 5,704,410

[45] Date of Patent: Jan. 6, 1998

[54] CURTAIN RAIL AND FLOWER RACK

[76] Inventor: Kun-Rong Kuo, Room 2, No. 30, Lane 429, Sec. 6, An-Chung Rd., Tainan, Taiwan

[21] Appl. No.: 739,209

[22] Filed: Oct. 29, 1996

[51] Int. Cl.[6] ..... E04F 10/00

[52] U.S. Cl. ..... 160/38; 211/90.2

[58] Field of Search ..... 160/38, 19, 39, 160/127; 211/90.2

[56] References Cited

U.S. PATENT DOCUMENTS

| | | | |
|---|---|---|---|
| 2,565,588 | 8/1951 | Bruno | 160/38 |
| 3,574,887 | 4/1971 | Schindlauer | 160/19 X |
| 4,114,233 | 9/1978 | Hamilton | 160/38 X |
| 4,921,031 | 5/1990 | Wagner et al. | 160/38 |
| 5,042,548 | 8/1991 | Attal | 160/38 |

*Primary Examiner*—David M. Purol

*Attorney, Agent, or Firm*—Morton J. Rosenberg; David I. Klein; Jun Y. Lee

[57] ABSTRACT

The present invention provides a rack that functions as a curtain rail guard or a flowerpot rack and is designed to be a Do-It-Yourself product. The rack includes a decorative front guard, two decorative side guards, several partition plates, several connecting angles and a tie plate. The tie plate can be fastened to a desired location. The connecting angles connect the front and side guards, and with the partition plates form a decorative rack that can be engaged to the tie plate with stay rails, to attach the assembly to the correct location on a wall, as a curtain rail guard or a flowerpot rack.

2 Claims, 3 Drawing Sheets

CURTAIN RAIL AND FLOWER RACK

BACKGROUND OF THE INVENTION

1. Field of the Invention

The present invention relates to a rack, and more particularly to a rack which is easy to assemble and has a decorative design for providing a more attractive appearance.

2. Prior Art

In the conventional curtain rail guard, the curtain rail is enclosed in the curtain rail guard with curtains being on the rail, in order to beautify the appearance thereof. In this case, the curtain rail guard not only works as a shield, but also functions as a decoration for the room. However, the installation of the conventional curtain rail guard is so complicated that it requires a skilled professional to install, as it is difficult for an ordinary person to install the guard.

Various DO-IT-YOURSELF products have been introduced into the marketplace and have been accepted by most customers, due to their easy installation and low cost. Hence DO-IT-YOURSELF designs have become part of modern life. The present invention is a DO-IT-YOURSELF design countering the shortcomings of the conventional curtain rail guard.

SUMMARY OF THE INVENTION

It is a main object of the present invention to provide a rack that functions as a curtain rail guard or a flowerpot rack that is designed as a Do-It-Yourself structure for convenience of the installation thereof and for decorative purposes.

The present invention includes a decorative front guard, two decorative side guards, a tie plate and a plurality of partition plates, cooperating with a plurality of connecting angles to link the two side guards and the front guard together. The assembly forms a decorative wall plate structure. By first securing a tie plate to a desired position on the wall of the room, the assembled rack is installed by coupling of the assembled rack to the tie plate.

DETAILED DESCRIPTION OF THE PREFERRED EMBODIMENTS

Figure 1:
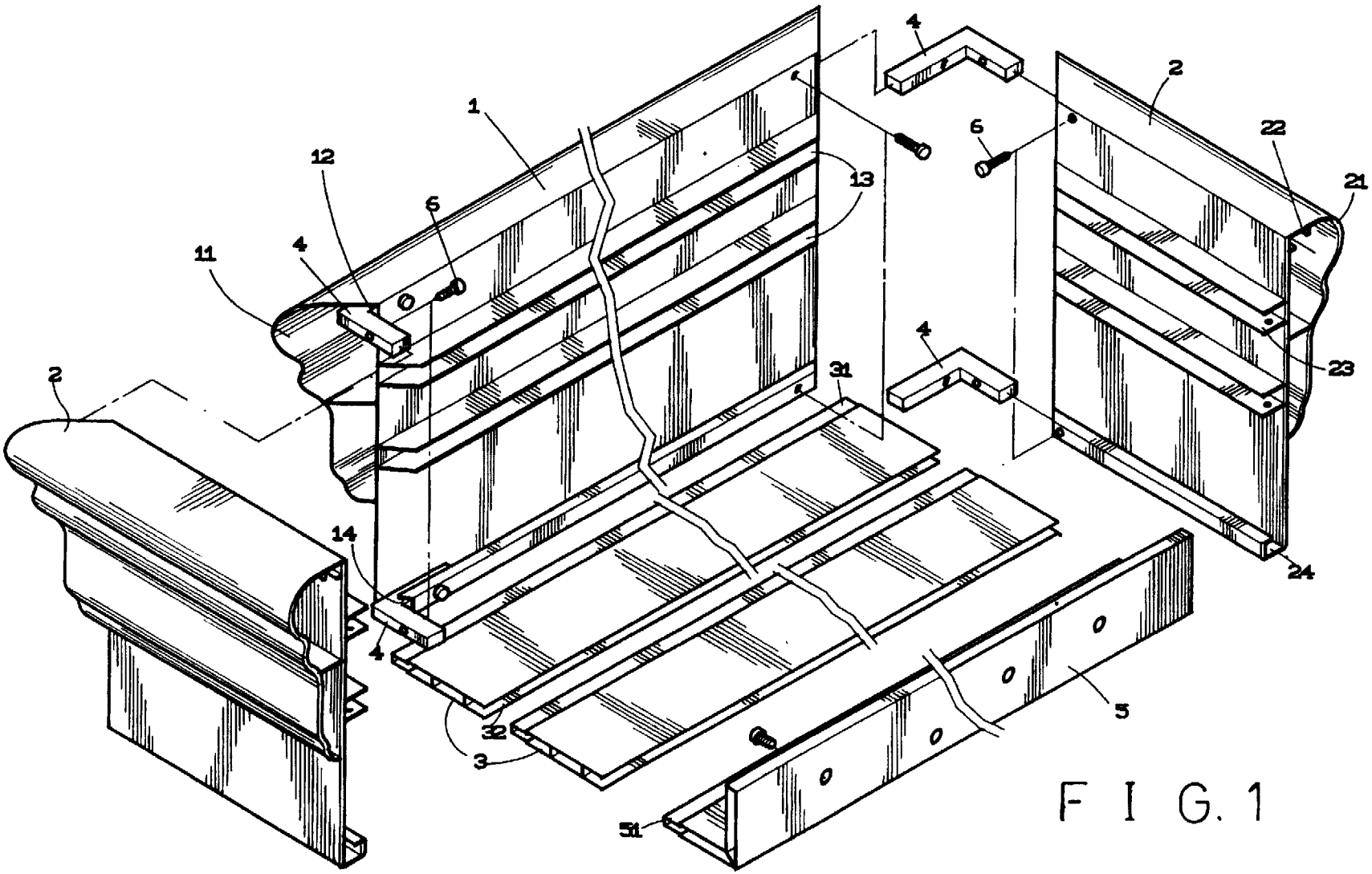
FIG. 1 is an exploded view of the present invention.

Referring to FIG. 1, the present invention is composed of a decorative front guard 1, two decorative side guards 2, a plurality of partition plates 3, a plurality of connecting angles 4 and a tie plate 5.

The decorative front guard 1 has an outwardly facing ornamental hollow body 11 formed on a front portion of a plate-shaped wall. Two flanges 12 are formed on the respective top corners thereof, to form a housing for receiving the connecting angles 4 therein. A pair of stay rails 13 are integrally formed on the inner surface of the wall of the front guard 1, and a hanger 14 is formed on the rear side of the front guard wall by the bent bottom portion thereof. The two decorative side guards 2 are formed with the identical structure of the decorative front guard 1 having ornamental hollow bodies 21, flanges 22, stay rails 23 and hangers 24.

The ornamental hollow bodies 11, 21 on the decorative front and the side guards 1 and 2 are beveled at the connecting corners to form a 90° connecting angle.

The partition plate 3 is a hollow flat plug-board with several reinforcing ribs on the inner wall. One side of the partition plate 3 is formed with a tenon 31 and the other side is formed with a mortise 32 for connection with a respective tenon 51 of the tie plate 5 or a tenon 31 of another partition plate 3.

The connecting angle 4 is an L-shaped right-angle connector for linking the decorative front guard 1 and the decorative side guard 2 together by inserting the connecting angle 4 into the spaces surrounded with the flanges 12, 22 or the hangers 14, 24.

The tie plate 5 is a hollow L-shaped right-angle plate with a tenon 51 formed on the distal end of the horizontally directed portion thereof, for insertion into a mortise 31 of a partition plate 3.

Figure 2:
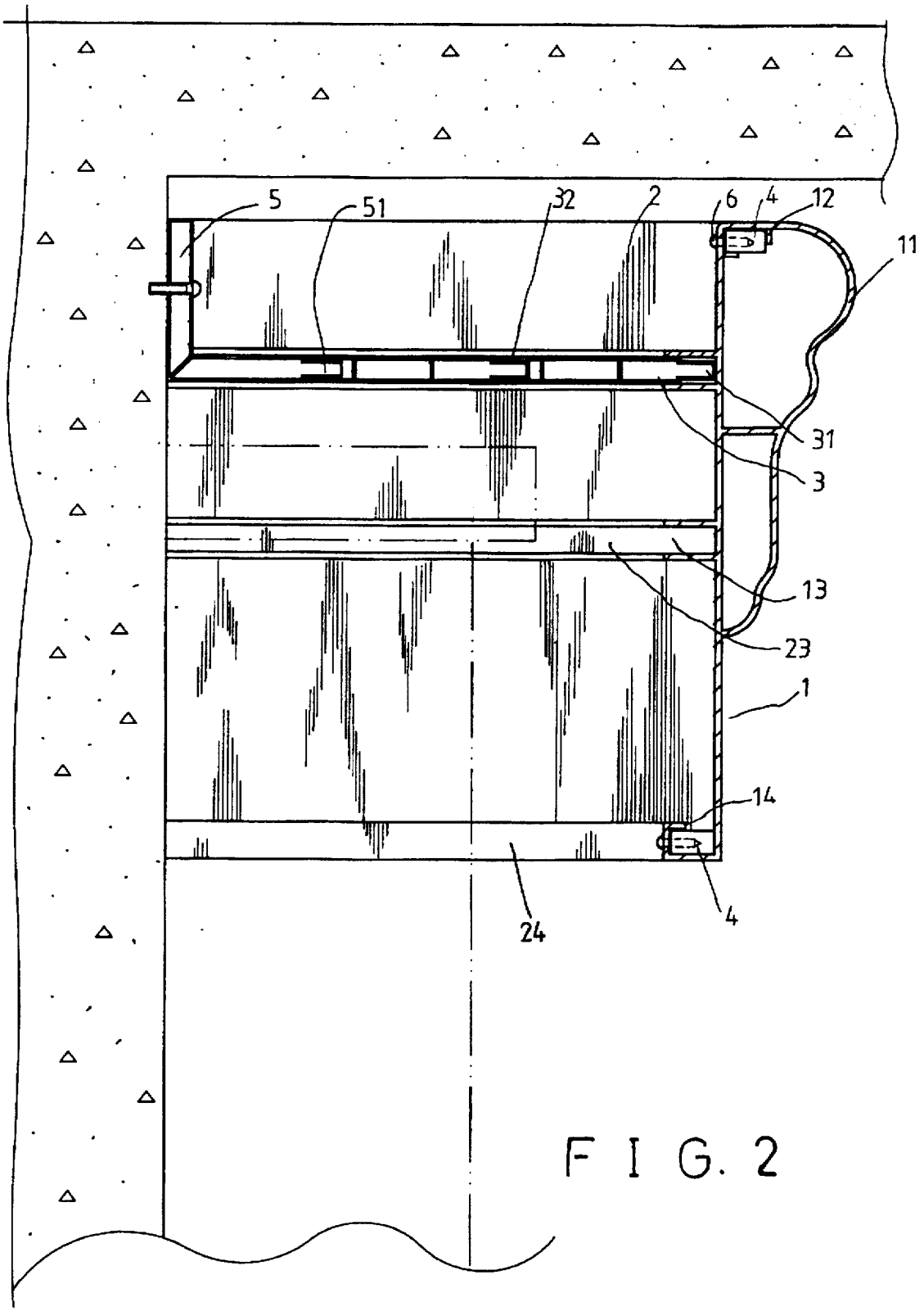
FIG. 2 is a side elevation view, partially sectioned, showing a curtain rail guard of the present invention; and, FIG. 3 is a side elevation view, partially sectioned, showing a flowerpot rack of the present invention.
Figure 3:
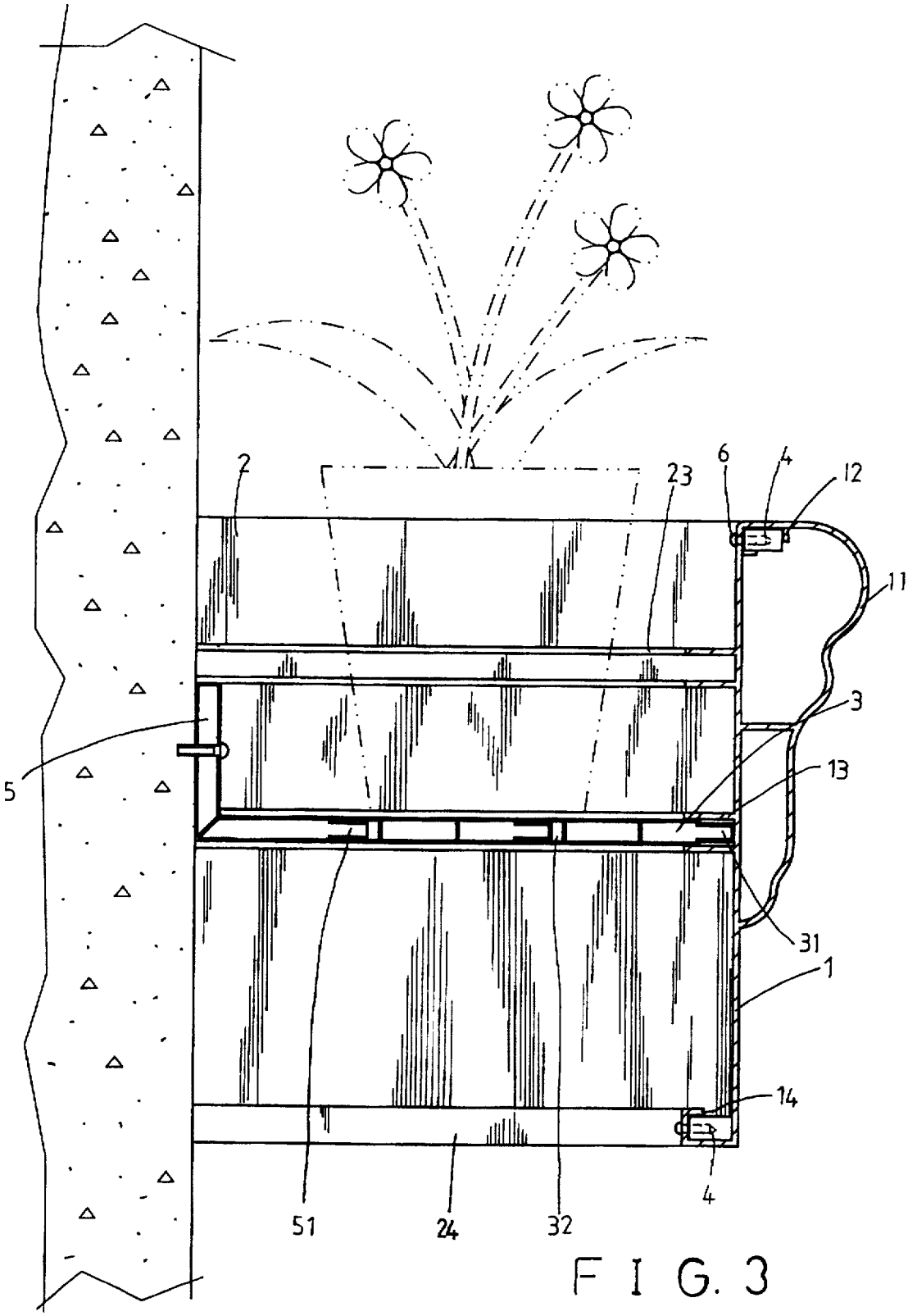

In assembling the structure, referring to FIG. 2, the connecting angles 4 are inserted into the spaces surrounded by the flanges 12, 22 and the hangers 14, 24 of the decorative front and side guards 1 and 2 respectively. The connecting angles are fastened to the guards by screws to form a U-shaped decorating frame. When that structure is adapted as a curtain rail guard, the tie plate 5 is fastened to an interior wall above a window, the partition plates 3 are inserted into the upper stay rails 13, 23, with the tenon portion 31 inserted into the upper stay rail 13 and the opposing side portions being received in the upper stay rails 23. The assembled decorating rack is mounted on the tie plate 5 by engaging the tenon 51 in the mortise 32 of a partition plate 3 and the side portions of the horizontal portion of tie plate 5 are inserted into the stay rails 23, and secured therein to secure the curtain rail guard in position. If the structure is to function as a flowerpot rack, as shown in FIG. 3, the partition plates 3 are inserted into the lower stay rails 13, 23. In that way, more space is provided for supporting flowerpots therein.

I claim:

1. A rack for use as a curtain rail guard or a flowerpot rack, comprising:

a decorative front guard member having (1) an ornamental front portion extending from a plate-shaped wall, (2) a pair of flanges secured to an upper end thereof to form a first connection receiving space therebetween, (3) a pair of first stay rails integrally formed on an inner surface of said front guide wall, and (4) a first hanger formed on a rear side of said front guide wall by a bent bottom edge portion of said front guide wall;

a pair of decorative side guards, each of said side guards having (1) an ornamental front portion extending from a plate-shaped wall, (2) a pair of flanges secured to an upper end thereof to form a second connection receiving space therebetween, (3) a pair of second stay rails integrally formed on an inner surface of said side guard wall, and (4) a second hanger formed on a rear side of said side guard wall by a bent bottom edge portion of said side guard wall, said front guard and said pair of side guards having beveled corner portions on corresponding ends thereof for forming a 90° connection therebetween;

a plurality of right angle shaped connectors for joining each of said pair of side guards to said front guard to form a U-shaped assembly, at least one of said plurality of right angle shaped connectors extending between said first and second connection receiving spaces, at least another of said plurality of right angle shaped connectors extending between said first and second hangers;

a partition plate having a substantially flat contour, said partition plate being received within a selected one of said first stay rails and corresponding second stay rails; and, an L-shaped tie plate having a vertically directed portion for coupling to a building structure and a horizontally directed portion received within said selected first stay rail and corresponding second stay rails.

2. The rack as recited in claim 1 where said partition plate has a tenon formed on a first edge thereof for insertion into said first stay rail and a mortise formed on an opposing edge thereof for receiving an edge portion of said tie plate therein.

* * * * *